US007838786B2

(12) United States Patent
Bizard et al.

(10) Patent No.: US 7,838,786 B2
(45) Date of Patent: Nov. 23, 2010

(54) SWITCHING APPARATUS

(75) Inventors: Bernard Bizard, Pudong Shanghai (CN); ZhenZhong Liu, Shanghai (CN); Pravin Sawant, Pudong Shanghai (CN)

(73) Assignee: Schneider Electric Industries SAS, Rueil Malmaison (FR)

( * ) Notice: Subject to any disclaimer, the term of this patent is extended or adjusted under 35 U.S.C. 154(b) by 366 days.

(21) Appl. No.: 11/988,877

(22) PCT Filed: Jun. 22, 2006

(86) PCT No.: PCT/EP2006/006005

§ 371 (c)(1),
(2), (4) Date: Jan. 16, 2008

(87) PCT Pub. No.: WO2007/022820

PCT Pub. Date: Mar. 1, 2007

(65) Prior Publication Data

US 2009/0266693 A1 Oct. 29, 2009

(30) Foreign Application Priority Data

Aug. 23, 2005 (CN) ..... 2005 1 0092767

(51) Int. Cl.
*H01H 3/40* (2006.01)

(52) U.S. Cl. ..... 200/501

(58) Field of Classification Search ..... 200/501, 200/331, 336
See application file for complete search history.

(56) References Cited

U.S. PATENT DOCUMENTS

| | | | | |
|---|---|---|---|---|
| 2,054,117 | A | 9/1936 | Alsaker et al. | 200/92 |
| 2,519,042 | A * | 8/1950 | Granberg et al. | 409/153 |
| 3,432,780 | A | 3/1969 | Evans et al. | 335/68 |
| 4,351,994 | A * | 9/1982 | Evans et al. | 200/400 |
| 5,856,642 | A * | 1/1999 | Sanders | 200/17 R |
| 6,166,343 | A * | 12/2000 | Blessitt et al. | 200/400 |

* cited by examiner

*Primary Examiner*—Felix O Figueroa
(74) *Attorney, Agent, or Firm*—Steptoe & Johnson LLP

(57) ABSTRACT

A switching apparatus has a frame with a circular notch in its operating surface; a operating handle disposed in the notch, said handle can change from a lower position corresponding to automatic mode to a upper position corresponding to manual mode, and the handle are rotatable in said circular notch in both positions; and gearing mechanism disposed in the frame, said gearing mechanism comprise a main gear, a clutch gear coupled to a motor, and a switch gear coupled to the main gear. The main gear, the clutch gear and the handle consist of a clutch device, such that in automatic mode the main gear engages the clutch gear and in manual mode the main gear disengaged from the clutch gear. Because the motor is disengaged from the main gear in the manual mode, the rotation of the operating handle will not interact with motor, so avoids possible confliction and resultant damage.

12 Claims, 11 Drawing Sheets

SWITCHING APPARATUS

FIELD OF THE INVENTION

The present invention relates to a switching apparatus with two operation modes, particularly to one used in ATSE (automatic transfer switching equipment).

BACKGROUND OF THE INVENTION

Switching apparatus are broadly used in many fields, such as emergency power supply. In case of a sudden power supply failure, typically a switching apparatus is activated to transfer the power line from normal power source to a replacement power source, such as a stand-alone generator. Most of the switching apparatus can be operated in two modes, i.e. automatically and manually, to accomplish said transferring motion.

Referring to FIG. 9 to FIG. 11, a conventional switching apparatus used in ATSE is shown. FIG. 9 is a top view of the conventional switching apparatus in manual mode, and FIGS. 10, 11 show a schematic cross sectional view of the conventional switching apparatus in automatic mode and manual mode respectively.

The conventional switching apparatus 1 has a frame 10, a handle 11, a clutch gear 12 driven by a motor via main gear (not shown), and a switch gear 13. The frame 10 has a circular notch 14 in its operating surface, and a support shaft 15, around which the handle can rotate to be lifted up.

In automatic mode, as shown in the FIG. 10, the handle 11 is in a lower position. The motor drives the main gear via clutch gear 12 to rotate, according to automatic operation signal received. Then the main gear drives the switch gear 13 to complete the motion of transferring a switching component to another position, and at same time the handle is driven to rotate too to provide corresponding position indication. Usually the handle 11 has a mark, which in combination with the marks on the operating surface of the frame 10, can indicate the amount of the rotation. For example, there are three marks on the operating surface of the frame 10, denoting an "OFF" position, a "N-ON" position and a "R-ON" position.

In manual mode, the handle 11 is lifted up, as shown in FIG. 11. A manipulator can rotate the handle 11, and the force applied by the manipulator then is transmitted to the switch gear 13. Like in automatic mode, the rotation angle is shown by means of the marks on the handle 11 and operating surface, and so the transferring process, such as transferring a power line to normal power source or to a replacement source, can be fulfilled properly.

However, in prior art, the handle 11 is coupled to the clutch gear 12 even when operated in manual mode. As the motor is connected to the clutch gear 12, additional force is needed to rotate the motor. Even when the power supply to the motor is cut off, the force required is quite large. But in the prior art assistant handle is a separate component and prone to loss. Besides this disadvantage, the prior art has a more serious drawback. In manual mode, due to possible misoperation, the motor may still have power supply and even receive false operation order, and the manual operation probably leads to damage of the motor and other safety problems.

SUMMARY OF THE INVENTION

An object of the present invention is to provide a switching apparatus operable in automatic mode and manual mode which is safer when operated in manual mode.

A switching apparatus according to present invention comprise a frame with a circular notch in its operating surface; a operating handle disposed in the notch, said handle are operable to change from a lower position corresponding to automatic mode to a upper position corresponding to manual mode, and the handle are rotatable in said circular notch in both positions; and gearing mechanism disposed in the frame, said gearing mechanism comprise a main gear, a clutch gear coupled to a motor, and a switch gear coupled to the main gear. The main gear, the clutch gear and the handle consist of a clutch device, such that in automatic mode the main gear engages the clutch gear and in manual mode the main gear disengaged from the clutch gear.

Compared to prior art, the switching apparatus according to present invention is safer in manual operation. Because the motor disengages from the main gear in the manual mode, the rotation of the operating handle will not interact with motor. So the manual operation does not influence/be influenced by the motion of the motor. Even in case of occurring a misoperation, e.g. a driving order is sent to the motor, the manual operation avoids possible confliction and resultant damage.

DETAILED DESCRIPTION

Figure 1:
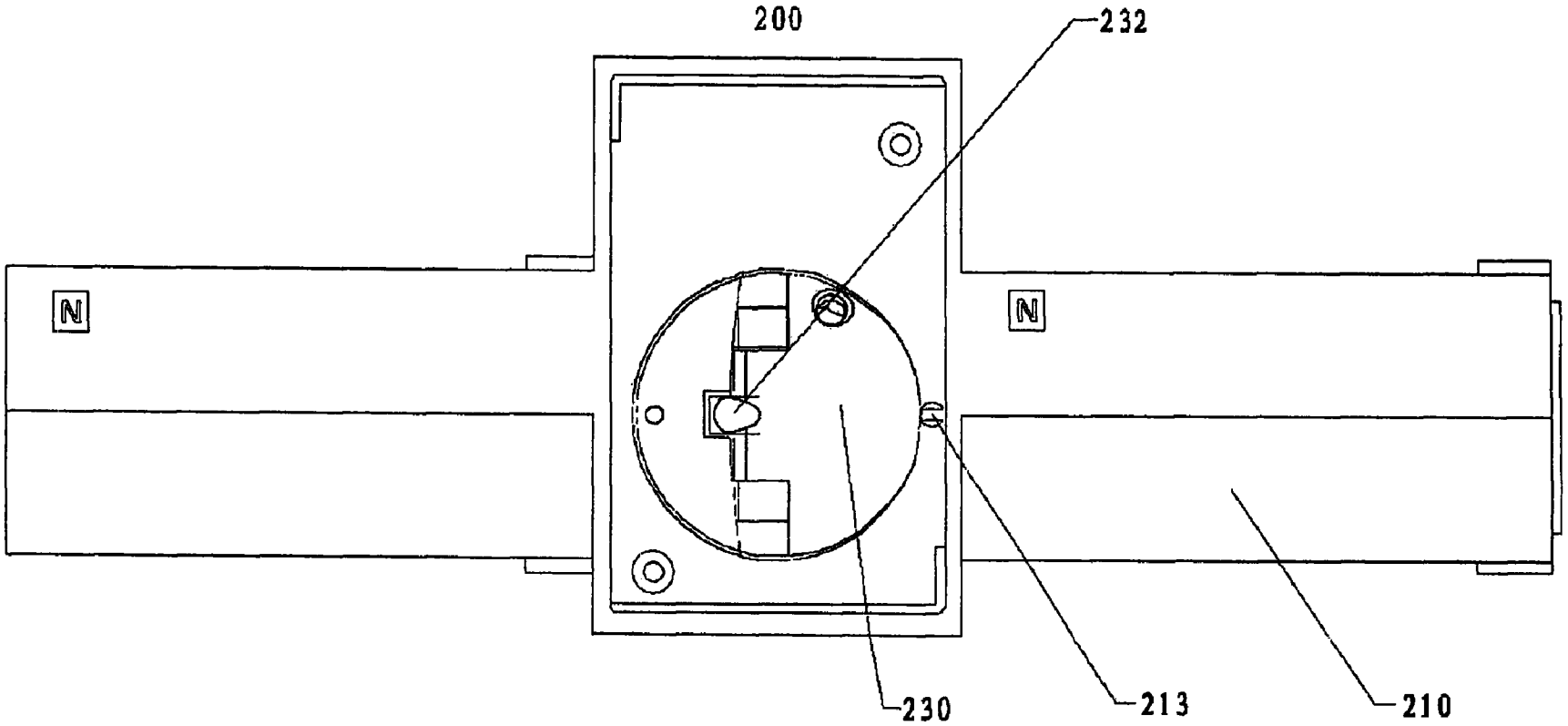
FIG. 1 shows a perspective view of the switching apparatus according to present invention in automatic mode.
Figure 2:
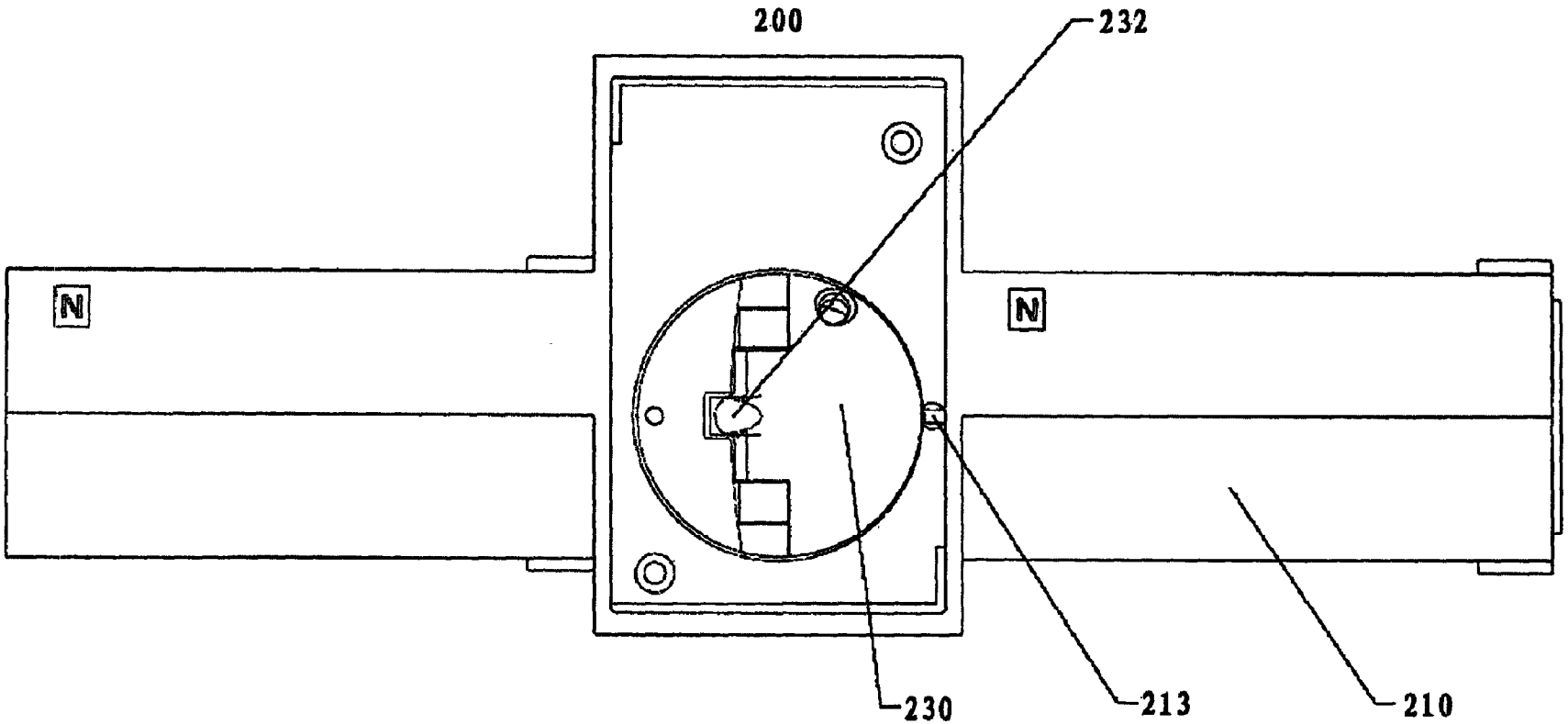
FIG. 2 is similar to FIG. 1, except that the switching apparatus according to present invention is in manual mode.
Figure 3:
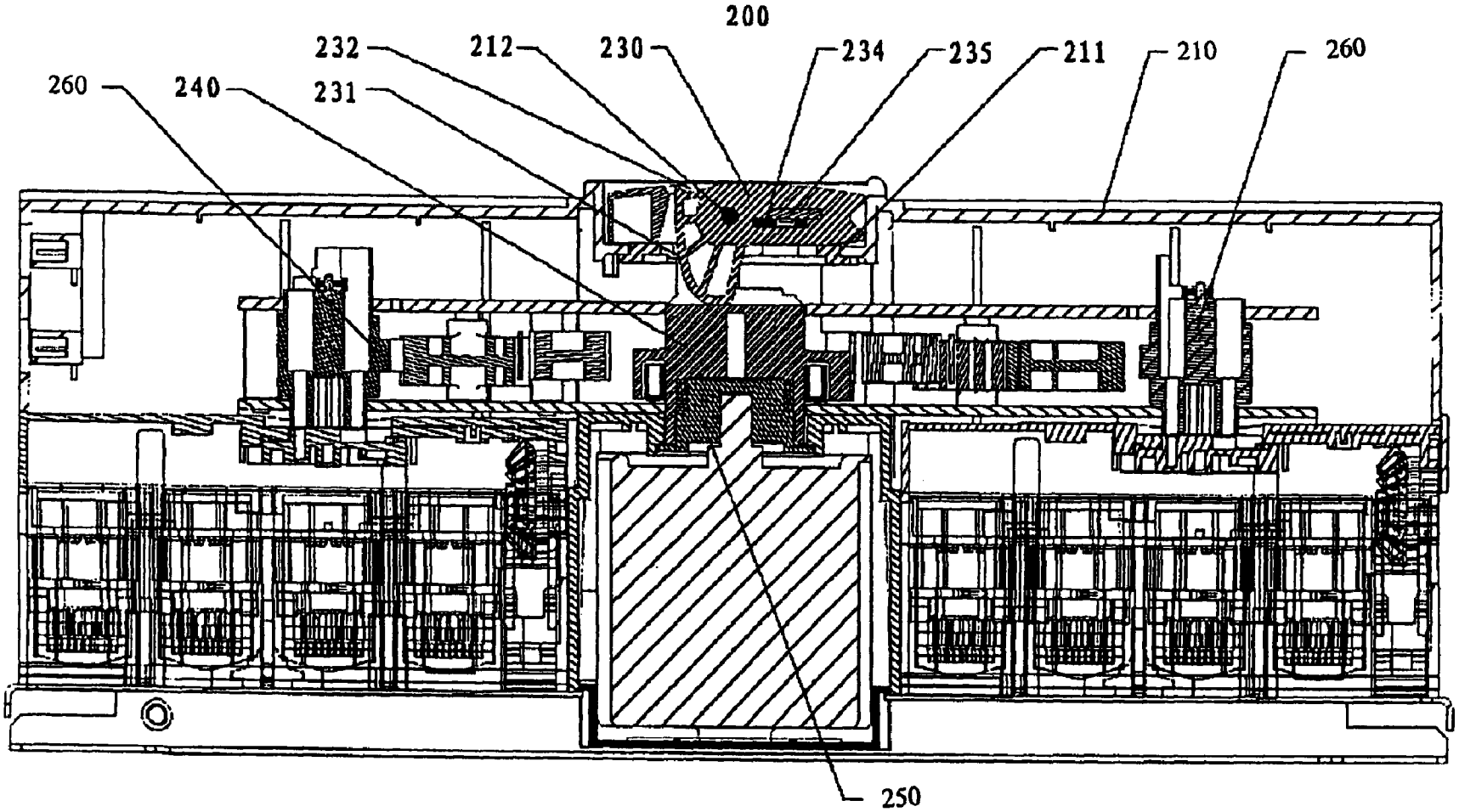
FIG. 3 shows a cross sectional view in clutching position along line A-A of FIG. 1.
Figure 4:
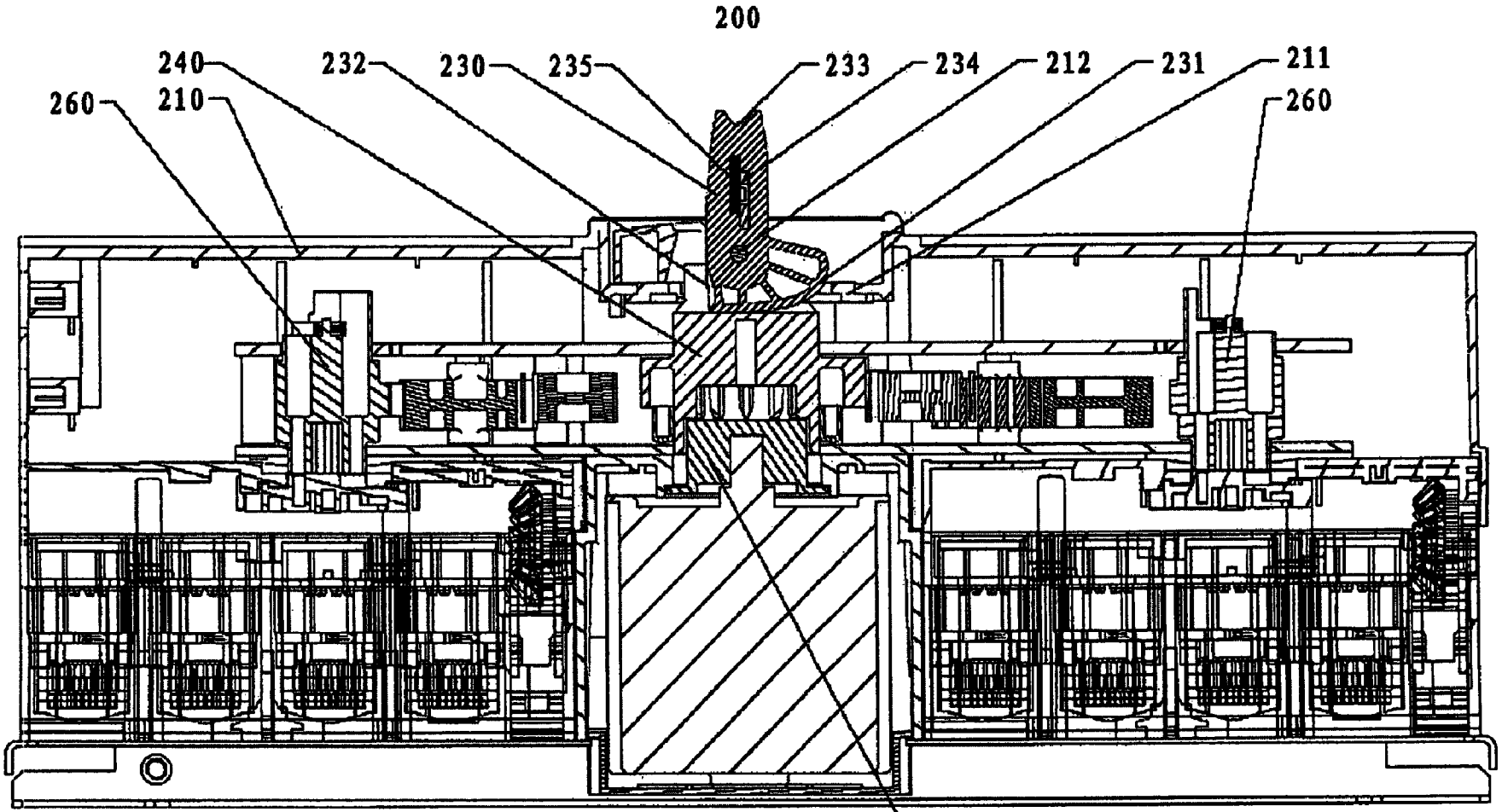
FIG. 4 shows a cross sectional view in declutching position along line A-A of FIG. 2.

Referring to FIG. 1 to FIG. 4, a switching apparatus according to an embodiment of the present invention is shown. FIG. 1 and FIG. 2 show perspective view of the switch apparatus in automatic mode and manual mode respectively. FIGS. 3 and 4 show cross sectional view along line A-A in FIG. 1 and FIG. 2 respectively. The switching apparatus 200 comprise a frame 210 with a circular notch 211 in its operating surface; a operating handle 230 disposed in the notch, and a gearing mechanism comprising a main gear 240 coupled to the handle 230, a clutch gear 250 coupled to a motor (not shown), and a switch gear 260 coupled to the main gear 240. The handle 230 is rotatable in the circular notch 211 around the circle center, and a portion of the handle 230 forms a cam 231. A support shaft 212 is fixed to the frame and penetrates the handle 230 such that the handle can rotate around it.

Referring to FIG. 1 and FIG. 3, in automatic modes, the handle 230 is in a lower position, and the whole handle does not protrude from the circular notch 211. The cam 231 presses the main gear 240 against the spring force to a lower position where the main gear 240 engages with and can be driven by the clutch gear 250. In the embodiment, the main gear 240 has a plurality of dents on the inner surface in its lower portion, which fit in with dents on the outer surface of the clutch gear 250 to form an inner gearing.

When a voltage is applied to the motor, the motor rotates and drives the clutch gear 250 to rotate. Since the main gear 240 clutches the clutch gear 250, the main gear 240 is driven to rotate too. That causes the switch gear 260 to rotate and accomplish the transferring motion of transferring a switching component, e.g. a switch, to another position. At the same time, the handle 230 rotates and indicates the rotation angle by means of marks thereon.

Referring to FIG. 2 and FIG. 4, in manual modes, the handle 230 is in an upper position, and the handle protrudes from the circular notch 211 upward and forms right angle with the operating surface. In this embodiment, to realize such a change, a manipulator first press an egg shaped hollow 232 on the handle 230 to generate a slight rotation, and then lifts the handle 230 to a vertical position by means of the depression 233 on one side of handle 230. As the handle 230 rotates, the cam 231 rotates too and the contact point between the cam 231 and the main gear 240 backs off in an upward direction. Thus the main gear 240 is pushed by a spring (not shown) to an upper position where the main gear 240 disengages from the clutch gear 250.

When the handle 230 is lifted up, it can be rotated by hand. Since the main gear 240 is coupled to the handle 230, the main gear 240 is driven to rotate too. That causes the switch gear 260 to rotate and accomplish the transferring motion. The rotation angle can be indicated by the marks on the handle 230 and the operating surface, so a desired rotation can be accomplished.

In this embodiment, the handle 230, the main gear 240 and the clutch gear 250 form a clutch device along with the spring. The clutch device realizes engagement and disengagement between the main gear 240 and clutch gear 250 by means of cam 231 and the spring. In manual mode, since the clutch gear 250 does not coupled to the handle 230 via the main gear 240 any more, the manual operation becomes easier and will not influence/be influenced by the motor. Therefore, the switching apparatus has enhanced safety in manual mode.

Figure 5:
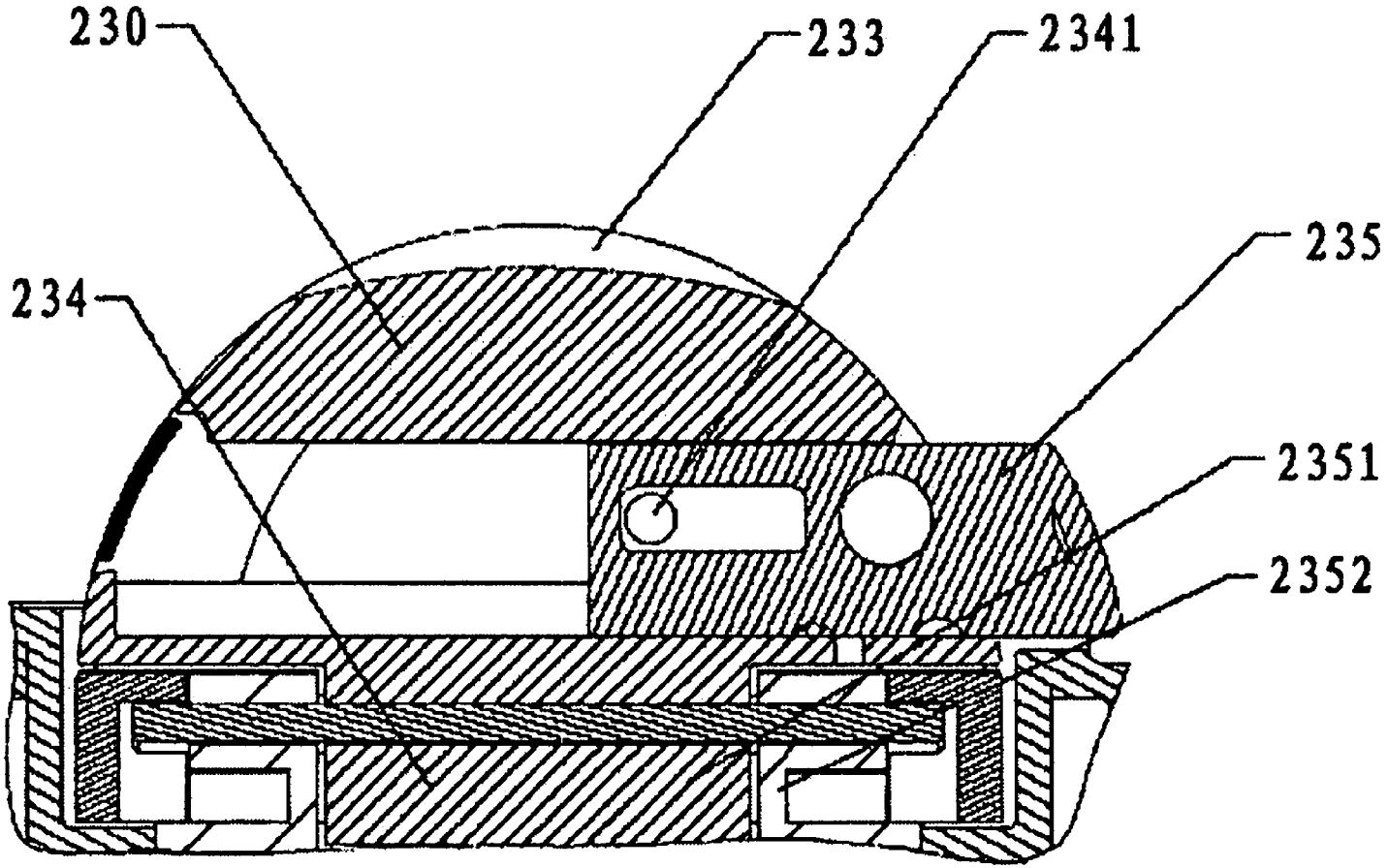
FIG. 5 shows cross sectional view of a handle with an extension member and a lock member when extension handle is inside the handle.
Figure 6:
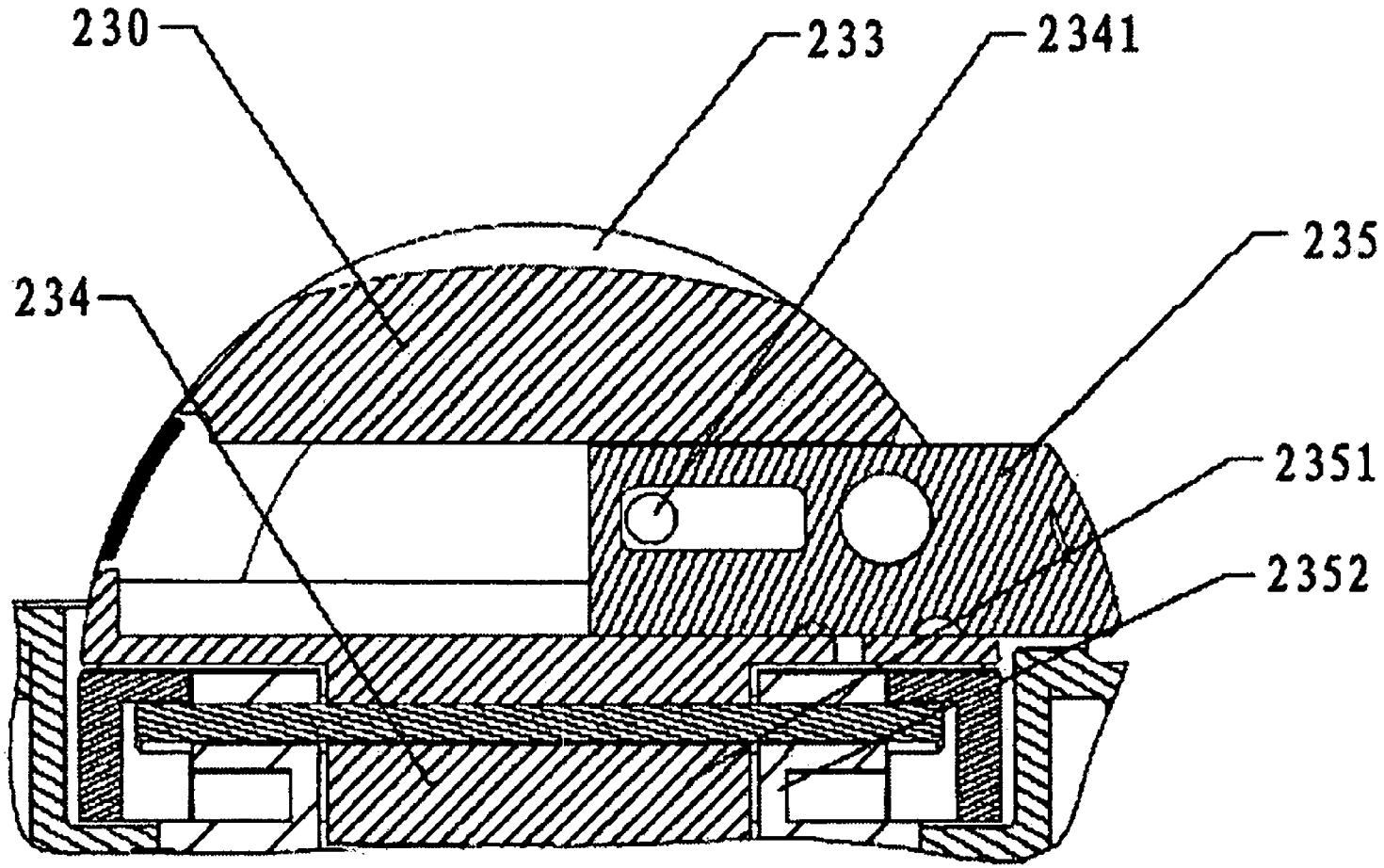
FIG. 6 shows another cross sectional view of the handle when extension handle is ready for operation (fully out) of FIG. 5.

Referring to FIG. 5 and FIG. 6, are enlarged cross sectional view of the operating handle in two states under manual operation. The operating handle 230 comprises an extension member 234 which can be inserted in a slot (not labeled), and drawn out from the slot in manual mode. When the extension member is drawn out from the slot, a larger torque is provided and makes the manual operation easier. When the switching apparatus is used in association with some particular switching components such as load switch, the manual operation force is required to be larger if provided same arm of force, because a load switch needs larger force to be transferred to another position than a breaker. Therefore the extension member 234 is especially useful when the whole apparatus is used with load switch. Alternatively, the extension member may be a folded configuration, which can be unfolded in manual mode.

Referring to FIG. 5 and FIG. 6 again, the handle 230 further comprises a lock member 235 which can be inserted in same slot and drawn out from the slot in manual mode. The lock member 235 has a limit slot 2351 corresponding to a limit protrusion 2341 formed on the extension member 234. As shown in FIG. 5, when the lock member is drawn out from the slot by suitable length, a lock hole 2352 formed in the lock member 235 reaches a same position of a locking hole 236 of the handle 230. A lock (not shown) can be used to lock the lock member 235 to the handle 230, and due to the presence of the limit slot 2351 and the limit protrusion 2341, the extension member 234 can not be drawn out. So it makes it impossible to draw out extension handle when the lock is inserted. On the contrary, in case of requiring a larger torque, the lock member 235 is movable in the slot, and the extension member 234 can be drawn out as shown in FIG. 6.

Figure 10:
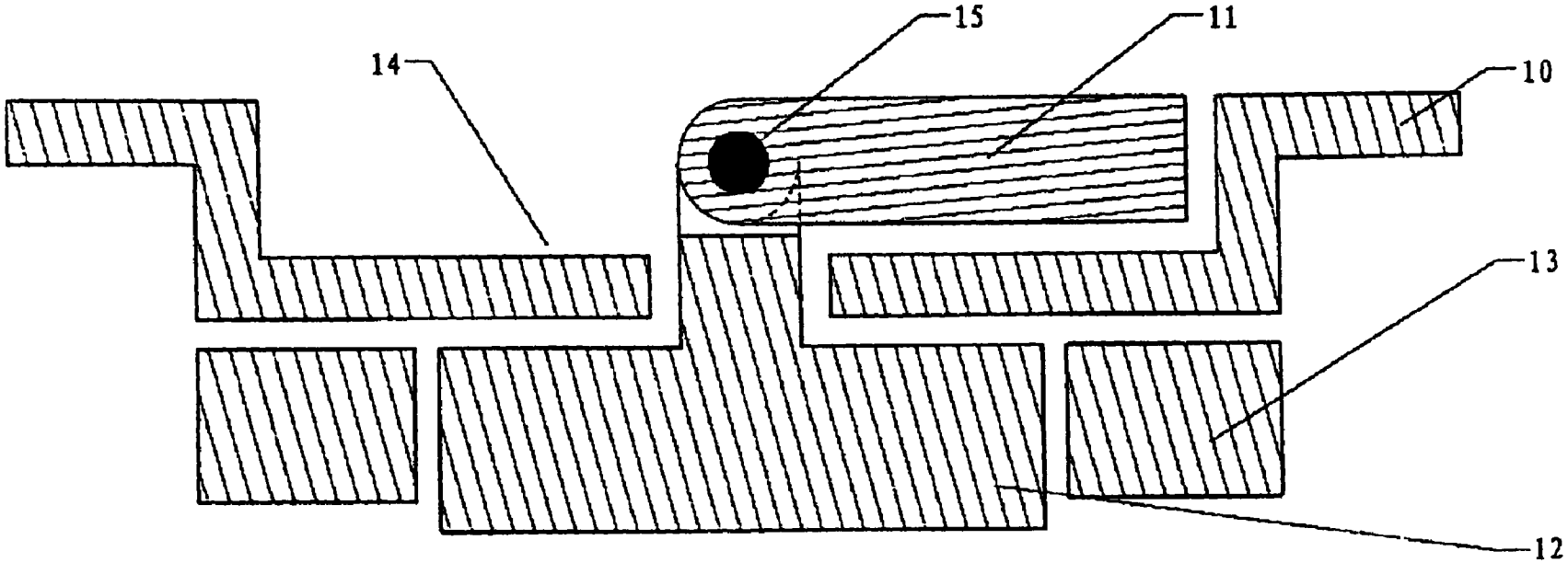
FIG.10 PRIOR ART
FIG. 10 show a schematic cross sectional view of the conventional switching apparatus in automatic mode.
Figure 11:
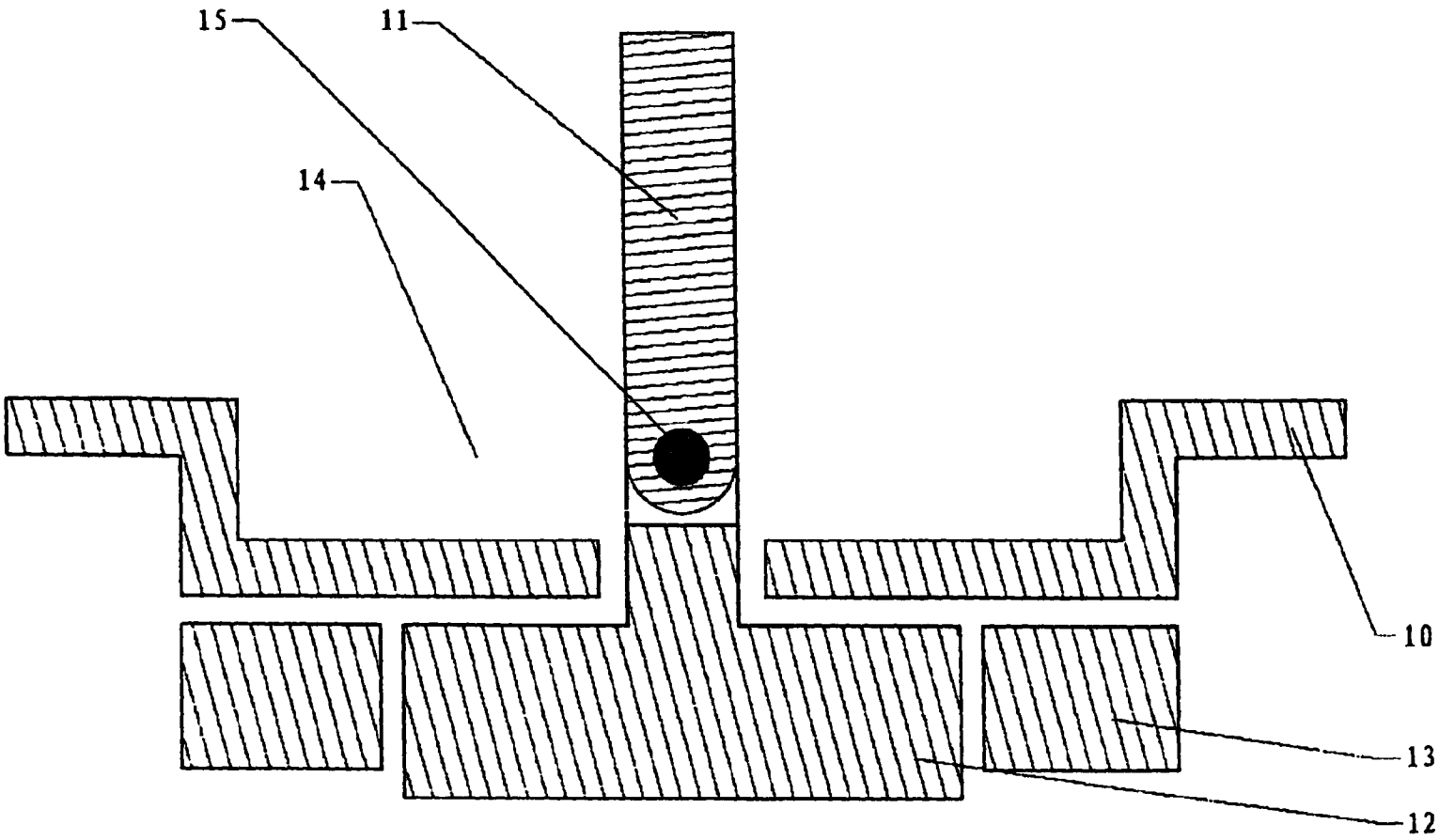
FIG. 11 PRIOR ART
FIG. 11 is similar to FIG. 10, except that the conventional switching apparatus is in manual mode.

Like the switching apparatus FIG. 10 in prior art, the switching apparatus 200 can be used in ATSE too. Three marks "OFF", "Normal" and "Back-up" are provided on the operating surface to indicate three switching states, that is, being turned off, being connected to normal power source and being connected to a back-up one. In certain cases the switching apparatus 200 may be required to be locked in one state, for example, off state. In this embodiment, the lock member 235 and a groove 213 (referring to FIG. 1 and FIG. 2) formed in the frame 210 cooperate to provide such a function. As seen from FIG. 2, when the handle 230 is turned to be in the off position, the lock member 235 can be drawn out and inserted into the groove 213 partly. Then the lock member 235 can be locked to the handle 230 due to the presence of the lock hole 2352 and the locking hole 236 so as to prevent the handle 230 from rotation. Its not possible to pull out the lock in any position other than OFF as the slot 213 is provided only in OFF, so making it impossible to lock in any position other than OFF, thus increasing the safety.

To make the switching apparatus 200 safer under manual operation, a cut-off switch (not shown) for cutting off the power supply to motor is provided. The cut-off switch is coupled to main gear 240. Therefore, even when an automatic operation order is sent to the motor by a misoperation, the motor will not receive the signal.

In the embodiment described above, the handle 230 change from a lower position to an upper position by rotation movement, and the main gear 240 is urged by the cam 231 and the spring to move correspondingly. So the handle 230, the main gear 240 and the clutch gear 250 constitute a clutch device. Certainly there are other ways of forming a clutch device functionally equivalent to said clutch device, and another possible construction for the clutch device is given as following.

Figure 7:
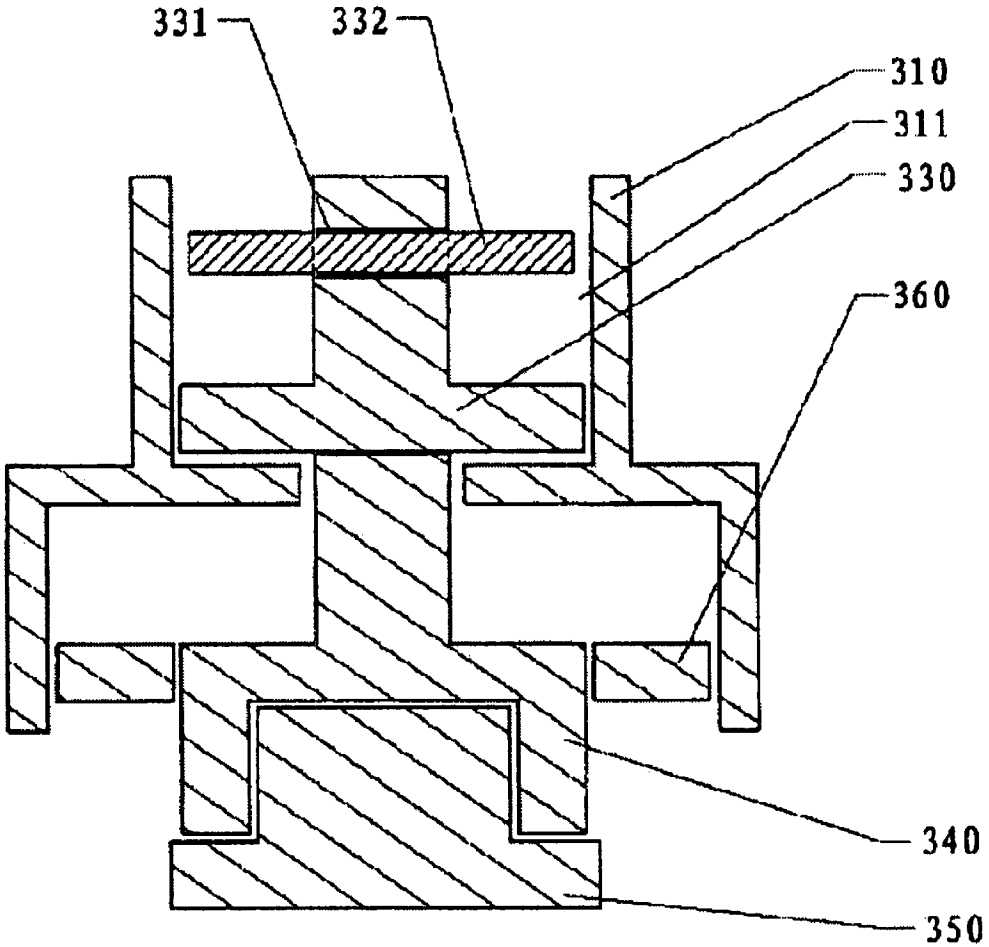
FIG. 7 shows a cross sectional view of another configuration of the clutch device of the switching apparatus according to present invention.

Referring to FIG. 7, the operating handle 330 can move in the circular notch 311 of a frame 310 upward and downward like a piston. The main gear 340 for driving switch gear 360 is fixed to the handle 330 to form an integral construction so that the movement of the main gear 340 is consistent with that of the handle 330. A clutch gear 350 is disposed under the main gear 340, so that the handle 330, the main gear 340 and the clutch gear 350 constitute a clutch device. A detachable or undetachable operating member 332 is disposed in a cylindrical slot 331 of the handle 330. The operating member 332 is used to pull the handle 330 and the main gear 340 to an upper position, i.e. manual operation position. The operating member 332 can be drawn out from the slot to provide a larger torque like the extension member 234. Alternatively, the operating handle 330 can be formed as a solid one with no slot inside it, but still has protrusion like the operating member. Because the handle 330 is expected to be under the level of the operating surface in its lower position, i.e. automatic operation position, the circular notch 311 may be deeper than the one shown in FIG. 1 to FIG. 6.

Figure 8:
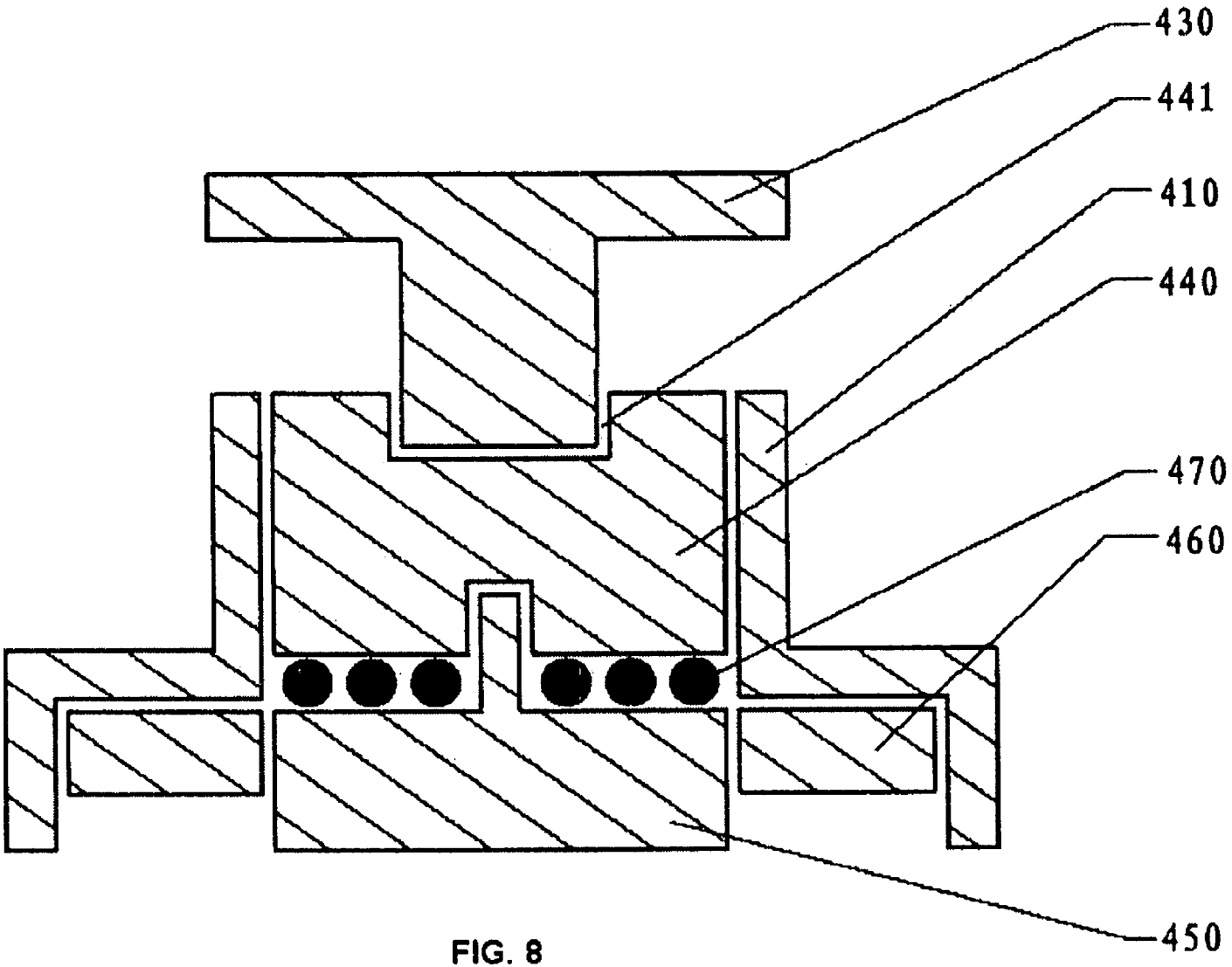
FIG. 8 shows a cross sectional view of yet another configuration of the clutch device of the switching apparatus according to present invention.
Figure 9:
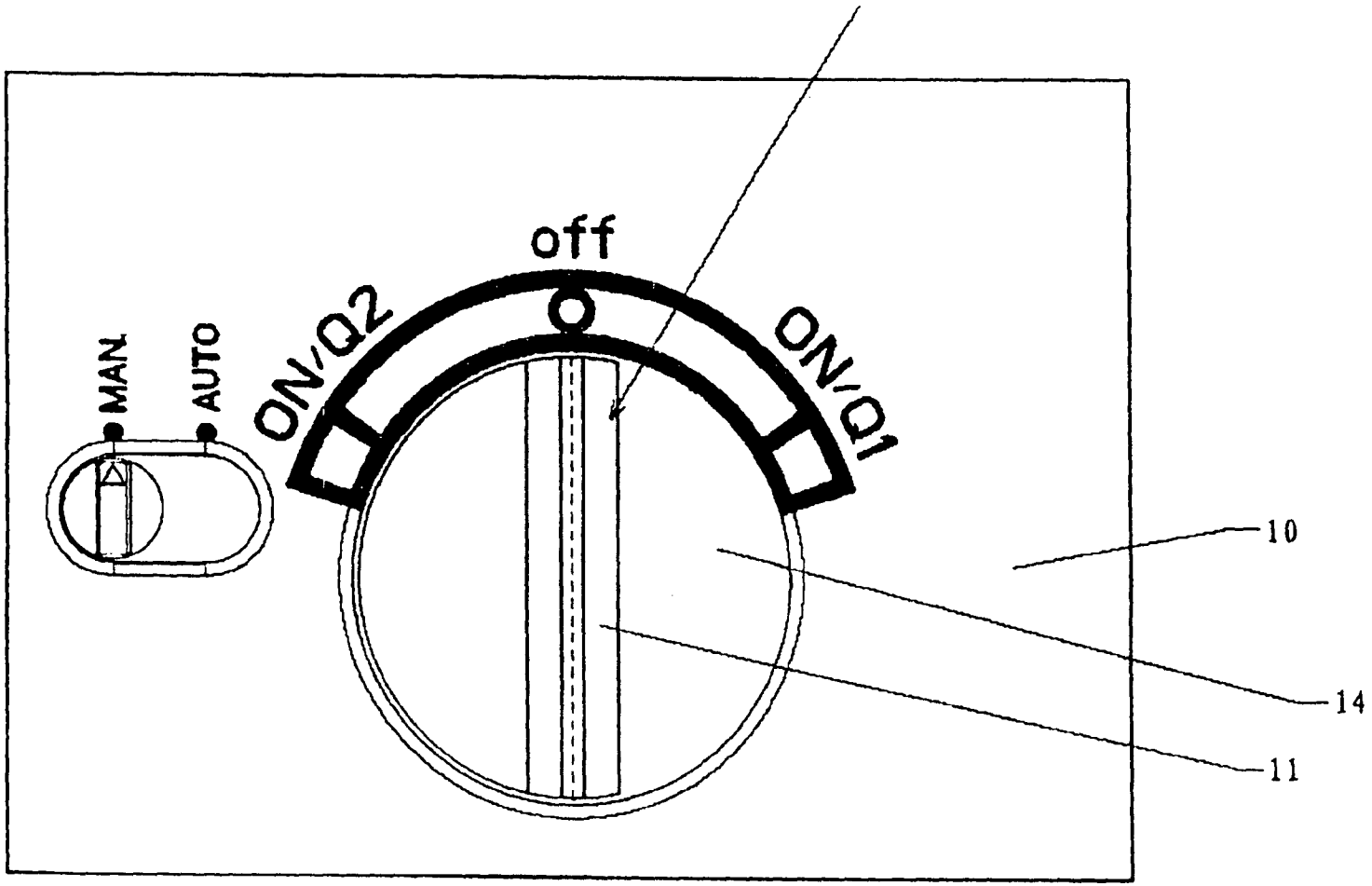
FIG. 9 PRIOR ART
FIG. 9 shows a top view of the conventional switching apparatus in manual mode.

Referring to FIG. 8, is another configuration of a clutch device composed of a main gear and a clutch gear. The main gear 440 can move in vertical direction in the frame 410 and push a clutch gear 450 downward. Both the main gear 440 and the clutch gear 460 can rotate around axis O without any interaction between them due to the ball bearing 470 disposed therebetween. In automatic mode, the clutch gear 450 engages with two switch gears 460 and so can drive them. An operating handle 430 may be used to press the main gear 440 and the clutch gear 450 to a lower position such that the main gear 440 substitutes the clutch gear 450 to drive the switch gear 460. The lower part of the operating handle 430 can insert into and fit with a slot 441 in the main gear 440, thus by turning the operation handle 430, the main gear 440 can be rotated around the axis O. In automatic mode, because the main gear 440 is not driven by the clutch gear 450, an indication component coupled to switch gear 460 may be needed to show the state at the moment, like marks of the switching apparatus described above.

The switching apparatus shown in FIG. 8 may be modified. For instance, the main gear may have a through hole along the axis O, and the operating handle can press the clutch gear directly and push it to the lower position. Such a configuration does not involve the movement of the main gear in vertical direction. Therefore a necessary arrangement is that the main gear engages with the switch gear in both automatic mode and manual mode.

Another modification, which may be simpler in conception but more complicated in construction, will be introduced herein. This time none of the main gear and clutch gear can move along the axis O. It is the movement of the switch gear which realizes the conversion from engagement to disengagement between the switch gear and the clutch gear. Since usually the number of the switch gear is more than one, such configuration may be more complicated.

In practical use, an idle gear may be needed to be set between the switch gear and the clutch gear as an intermediate drive gear.

Given the foregoing description and drawings, the conception of present invention has become clear. That is, in automatic mode, an automatic operation unit, i.e. clutch gear, engages with the switching mechanism, i.e. switch gear; and in manual mode, disengagement takes place between them. During the period of transferring the switching apparatus from automatic mode to manual mode, at least one of the automatic operation unit and the switching mechanism is moved to cause the disengagement. Then a manual operation unit, i.e. the combination of the operation handle and the main gear, is used and drive the switching mechanism. It should be understood, that when adopting a configuration like that in FIG. 1 to FIG. 4, the main gear is a common parts of the automatic operation unit and manual operation unit. In that embodiment, the main gear and handle constitute the manual operation unit, and the main gear combines with clutch gear to form the automatic operation unit at the same time.

While the principles of the invention have been shown and described in connection with a preferred embodiment, it is to be understood that such embodiment is exemplary and not limiting.

The invention claimed is:

1. A switching apparatus operable in each of an automatic mode and a manual mode, comprising:

a frame with a circular notch in its operating surface, an operating handle in the notch, said handle being movable to change from a first position corresponding to automatic mode to a second position corresponding to manual mode, a gearing mechanism in the frame, said gearing mechanism comprising a main gear coupled to the handle, a clutch gear coupled to a motor, a switch gear coupled to the main gear, said switch gear having at least two switch positions, wherein the main gear, the clutch gear, the switch gear and the handle are constructed such in that automatic mode, the main gear engages the clutch gear and is rotatably driven by the clutch gear that causes the switch gear to accomplish a transferring motion of the switch gear, the handle rotating and indicating the rotation angle of the handle by marks on the handle and on the operating surface, and in manual mode, the main gear disengages from the clutch gear and is driven to rotate by the handle, that causes the switch gear to rotate and accomplish the transferring motion of the switch gear.

2. The switching apparatus according to claim 1, wherein the switching apparatus comprises a support shaft fixed to the frame, around which the handle rotates.

3. The switching apparatus according to claim 2, wherein in the manual mode the handle protrudes from the circular notch upward at a right angle with an operating surface, the cam pressing the main gear to a upper position wherein the main gear disengages from, and can not be driven by, the clutch gear.

4. The switching apparatus according to claim 2, wherein the handle further comprises a cam pressing against the main gear, so that when the handle rotates around the support shaft, the main gear is forced to move via the cam.

5. The switching apparatus according to claim 4, wherein the main gear has a plurality of gear teeth on the inner surface of its lower portion, which mesh with gear teeth on the outer surface of the clutch gear to form an inner gearing.

6. The switching apparatus according to claim 2, wherein the switching apparatus comprises a biasing means for biasing the main gear toward the handle.

7. The switching apparatus according to claim 2, wherein the switching apparatus comprises a lock member, which can be locked to inhibit the rotation of the operating handle in the notch in manual mode when the handle corresponds to certain.

8. The switching apparatus according to claim 7, wherein the extension member is contained in a slot of the handle, and can be drawn out in manual mode.

9. The switching apparatus according to claim 8, wherein the operating handle further comprises an extension member for increasing torque in manual mode.

10. The switching apparatus according to claim 1, wherein the handle can move in the circular notch vertically, from the lower position to the upper position.

11. The switching apparatus according to claim 1, wherein the handle and the main gear form an integral construction.

12. The switching apparatus according to claim 1, wherein the switching apparatus comprises a cut-off switch, which cut off the power supply to the motor in manual mode.

* * * * *